US010281135B1

(12) United States Patent
Saraceni

(10) Patent No.: US 10,281,135 B1
(45) Date of Patent: May 7, 2019

(54) CLOUD SPEAKER LAMP DEVICE FOR PRODUCING LIGHT AND SOUND

(71) Applicant: Remo Saraceni, Philadelphia, PA (US)

(72) Inventor: Remo Saraceni, Philadelphia, PA (US)

( * ) Notice: Subject to any disclaimer, the term of this patent is extended or adjusted under 35 U.S.C. 154(b) by 0 days.

(21) Appl. No.: 15/888,029

(22) Filed: Feb. 4, 2018

Related U.S. Application Data

(60) Provisional application No. 62/456,229, filed on Feb. 8, 2017.

(51) Int. Cl.

| | |
|---|---|
| ***H04R 1/02*** | (2006.01) |
| ***A63J 17/00*** | (2006.01) |
| ***F21V 15/01*** | (2006.01) |
| ***F21V 23/00*** | (2015.01) |
| ***F21V 33/00*** | (2006.01) |
| ***H05B 37/02*** | (2006.01) |

(52) U.S. Cl.
CPC ..... *F21V 33/0056* (2013.01); *A63J 17/00* (2013.01); *F21V 15/01* (2013.01); *F21V 23/003* (2013.01); *H04R 1/02* (2013.01); *H05B 37/0236* (2013.01)

(58) Field of Classification Search
CPC ..... F21V 1/22; F21V 21/02; F21V 23/003; F21V 33/0056
USPC ..... D26/125
See application file for complete search history.

(56) References Cited

U.S. PATENT DOCUMENTS

| | | | | |
|---|---|---|---|---|
| 6,314,669 | B1 * | 11/2001 | Tucker | G09F 9/33 340/815.45 |
| 2005/0116667 | A1 * | 6/2005 | Mueller | E04F 13/08 315/312 |
| 2015/0029718 | A1 * | 1/2015 | Cook | F21K 9/50 362/235 |
| 2015/0070658 | A1 * | 3/2015 | Poesch | F21V 33/0056 353/19 |
| 2017/0175993 | A1 * | 6/2017 | Fornataro | A47G 33/08 |

* cited by examiner

*Primary Examiner* — Robert J May
*Assistant Examiner* — Leah S Macchiarolo
(74) *Attorney, Agent, or Firm* — Joseph E. Maenner; Maenner & Associates, LLC

(57) ABSTRACT

A mountable cloud speaker lamp system produces both audio and visual output for the purpose of enjoyment and relaxation. The cloud speaker lamp system includes a cloud shaped enclosure with a cloud shaped front shell and a flat back shell; an electro acoustic transducer for sound generation mounted on the enclosure back shell; a light source mounted on the enclosure back shell for projecting light onto the cloud shaped enclosure front shell; an input interface mounted on the enclosure back shell containing an audio input and command receiver for receiving sound and light commands from an external source, an audio amplifier to amplify the input audio and generate bands of sound corresponding to light intensity, and an illumination driver to drive the light source; and a power source. The system is configured so that a single enclosure design encompasses the cloud appearance, and provides a sound and light radiating surface.

18 Claims, 10 Drawing Sheets

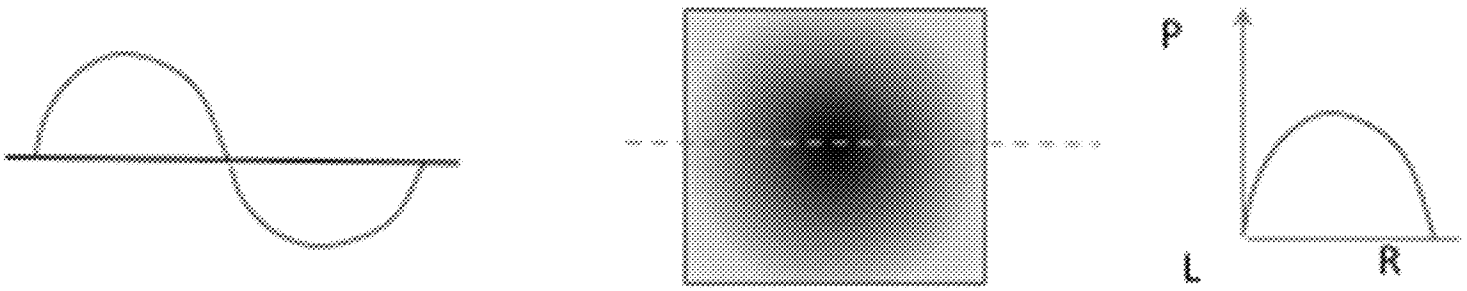
FIG. 3A
FIG. 3B
FIG. 3C
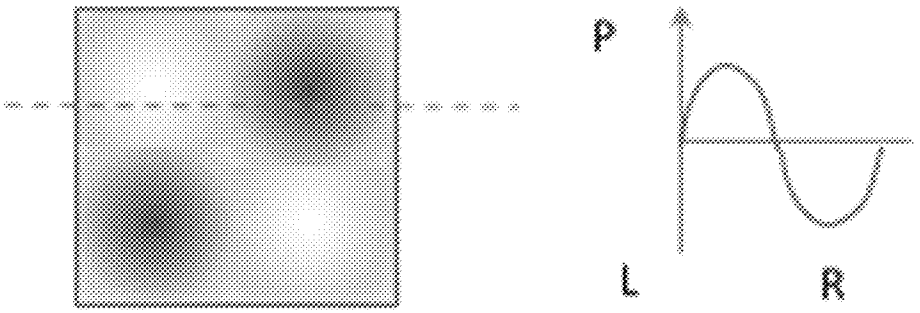
FIG. 4A
FIG. 4B

CLOUD SPEAKER LAMP DEVICE FOR PRODUCING LIGHT AND SOUND

CROSS-REFERENCE TO RELATED APPLICATION

The present application claims priority from U.S. Provisional Patent Application Ser. No. 62/456,229, filed on Feb. 8, 2017, which is incorporated herein by reference in its entirety.

BACKGROUND

The following description includes information that may be useful in understanding the current invention. It is not an admission that any of the information provided herein is prior art or relevant to the presently claimed invention, or any publication specifically or implicitly referenced as prior art.

The cloud speaker lamp relates generally to a device which produces both audio and visual output for the purpose of enjoyment, relaxation and the like. This invention makes use of certain synergies between the technologies of audio, illumination, music, and mechanical construction. It includes the combination of lighting and sound.

Electronics have been used since their inception for producing radiated sound. The history of electronic signals creating mechanical motion resulting in radiation of sound waves extends from the earliest cardboard-cone loudspeakers with the cone placed in motion by a coil in a magnetic field. The cloud speaker lamp achieves mechanical motion via an enclosure, coupled to a transducer.

The enclosure plays an important role in the resulting sound, since its construction directly determines the efficiency of conversion from the electrical impulse to a mechanical input via the transducer and then to a sound pressure at each frequency in the audio band. Enclosure designs have ranged from simple rectangular boxes to elaborate labyrinths featuring internal ducting and external ports. Some designs introduce a combination of direct sound radiation from cardboard loudspeaker cones facing the listening area, and reflected radiation of the same program material aimed at the surface behind the device. The various technologies have largely achieved the goal of accurate realistic reproduction of electronic audio signals, providing a consistent level of conversion of voltage into sound pressure.

The history of stringed musical instruments has highlighted a different set of requirements in the production of radiated sound. Throughout the development of these instruments the construction of the instrument has been recognized as crucial to production of the proper tone, related to the frequency modifications applied to the tones by the construction. A simple example is the shape of the body of a guitar or violin resembling a dog bone with one end larger than the other to create two distinct resonances in the audio range. A Stradivarius violin looks similar to a music store violin, but the sound quality of the two instruments is worlds apart. This is the result of hundreds of details of material thickness, bracing, and shape which create a very specific frequency characteristic in the vintage instrument. This sound production system depends on the enclosure construction to provide warmth and personality to the original tone. The ultimate goal of the cloud speaker lamp with regard to the sound generation is a full-range audio reproduction system, enhanced using the techniques described herein, which provides a distinctive sound combined with the ability to reproduce the audio content while staying within the visual and functional requirements.

BRIEF SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

The cloud speaker lamp is a device for producing light and sound. This device comprises an enclosure, an input interface, a transducer, a light source, and a power source.

The enclosure is used as an acoustic resonating chamber and a translucent light projector. The enclosure has a front shell, a back shell, a plurality of cone shaped standoffs for mounting. The enclosure front shell is cloud shaped, the back shell is flat. The back shell has a sound opening to facilitate the movement of air. The back shell has a back shell internal surface and a back shell external surface. The back shell external surface mounts on a mounting surface via the cone shaped standoffs. The enclosure can utilize a continuous thin material such as an acrylic or other plastic.

The input interface may be configured to receive an audio input signal and a command input signal. The input interface further has an audio and command receiver, which receives the audio input signal and the command input signal from an external source; an audio processor, further having an audio filter and audio amplifier, the audio amplifier receives the audio input signal from the audio and command receiver and generates an amplified audio signal, the audio filter receives the audio input from the audio and command receiver and generates a processed audio signal which selects sound frequency corresponding to light intensity; and an illuminations driver which receives the command signal from the audio and command receiver and the processed audio signal from the audio amplifier. The processed command signal controls color selection and the processed audio signals control light intensity.

The input interface receives the audio signal from an external source. The external source may be a smart phone, a computer for audio and command signals, or an MP3 player for audio signals.

In one of the embodiments the input interface may be a Bluetooth unit which combines a receiver for control signals, an audio amplifier capable of driving the transducer, and an audio filter system which picks out bands of sound and uses the intensity levels to control the light source LED lighting in Red, Green, Blue, and white. The input interfaces may be a 10 Watt amplifier with a Bluetooth antenna interface.

In still another embodiment, the cloud speaker lamp may be used as a loudspeaker component where there is a wire connection from the audio source. The audio source may be a mobile phone or a computer or any other device with a wire enabled output for transmission of the audio signal.

The transducer receives sound input from the audio amplifier in the audio processor which is part of the input interface and acoustically excites the enclosure. The transducer is connected to the back shell internal surface. The location of the transducer connection to the back shell internal surface is selected to optimize the audio characteristics of the enclosure speaker system.

The light source receives the command signal and the processed audio signal from the illumination driver in the input interface. The command signal commands color selections, and the processed audio signal results in pattern generation and light intensity variations. The light source is mounted on the back shell internal surface. The light source may produce a range of white or near white light output as well as multi colored light output. The light source can be an LED array.

The power source can be alternating current or direct current. The direct current power source may be a battery.

Other features and advantages of the invention are apparent from the following description, and from the claims.

BRIEF DESCRIPTION OF THE DRAWINGS

Exemplary embodiments of the invention are described below with reference to the drawings, wherein like numerals are used to refer to the same or similar elements.

FIG. 3A is an exemplary embodiment of a sound wave;

FIG. 3B is the mode 1 illustration of a flat plate;

FIG. 3C illustrates a plot of displacement vs. locations relative to the first mode;

FIG. 4A is the mode 2 illustration;

FIG. 4B is an exemplary embodiment of the sound wave of the mode 2 illustration;

DETAILED DESCRIPTION

Figure 1:
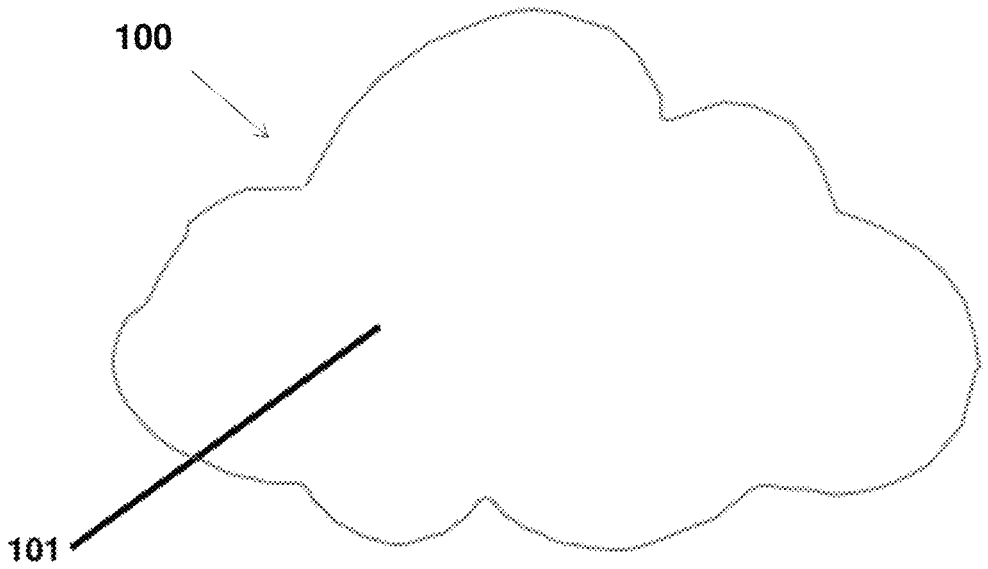
FIG. 1 is the outline of the cloud speaker lamp enclosure.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Single Channel Audio

Referring to FIG. 1, the overview of the concept and general appearance of a Cloud Speaker Lamp 100 ("lamp 100) is illustrated. Lamp 100 is intended to resemble a cloud visually and provide visual and audio entertainment. Lamp 100 can be mounted on a wall or other surface. Lamp 100 includes a means of playing recorded sound and also functions as room lighting device by providing both white and color illumination. Lamp 100 can be connected to a low voltage power source using a conventional wall-mounted power supply and a thin wire or a strip of conductive tape. Lamp 100 can also be powered by a rechargeable battery.

Central to this invention, illustrated in FIG. 1, is the use of the enclosure shell 101 of lamp 100 as both a sound and a light projecting element. The enclosure shell material may be optimized to produce a maximum of light transmission with a minimum of visibility of the exact shapes, electronics, or light sources inside the enclosure. The objective of the enclosure design relative to light transmission is to pass as much light of all wavelengths, be as colorless as possible, and avoid specific visibility of the light source or other internal parts. From a mechanical perspective, the enclosure should have thin walls of adequate strength to support the internal components and mounting.

Figure 1A:
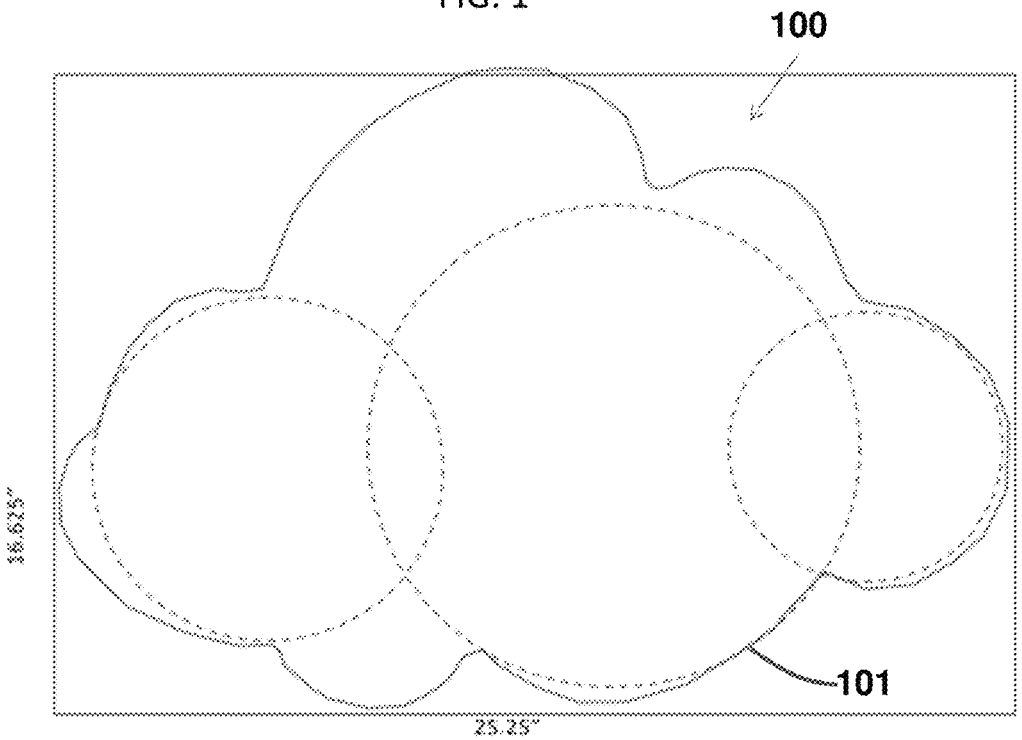
FIG. 1A is an illustration of the dimensions of the first embodiment.
Figure 1B:
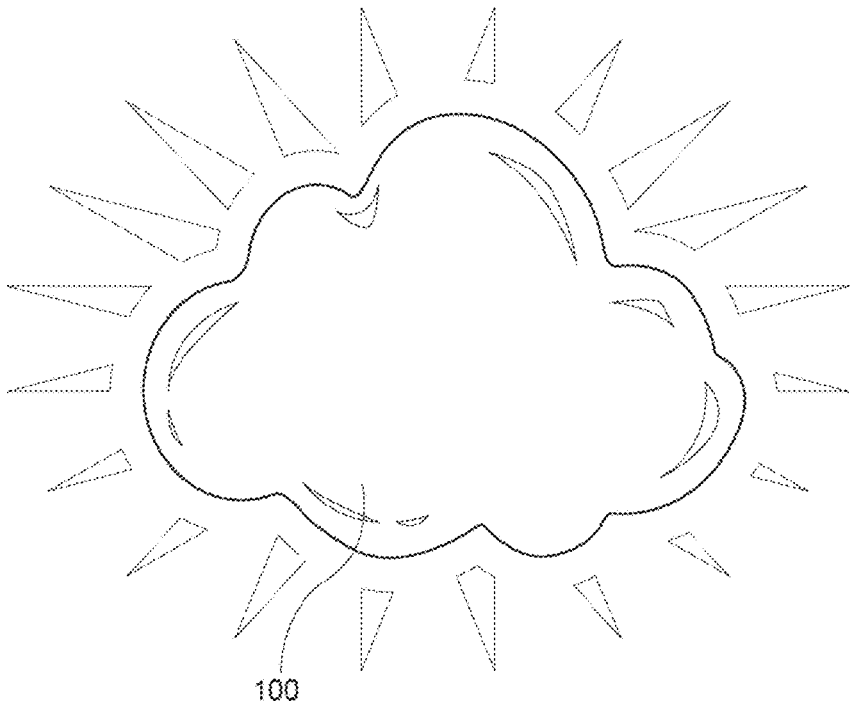
FIG. 1B is a three-dimensional embodiment of the invention.

The choice of a hollow cloud type construction provides the ability to control some troublesome aspects of sound generation and apply elaborate sound conditioning to add warmth and character to the audio output, analogous to the effect which construction has on a fine violin. The lamp 100 may not attempt a flat or high-fidelity specification, but rather an interesting and pleasing tonal character. An approximate dimension of the first embodiment is illustrated in FIG. 1A. The depth of the enclosure in FIG. 1A is approximately six inches. The FIG. 1A dimensions of the cloud speaker lamp shell 101 can be larger or smaller as long as the enclosure is optimized to produce an interesting and pleasing tonal character as described herein. FIG. 1B shows a commercial embodiment of lamp 100. Lamp 100 has a translucent outer shell 101.

Transducer Placement

Figure 2:
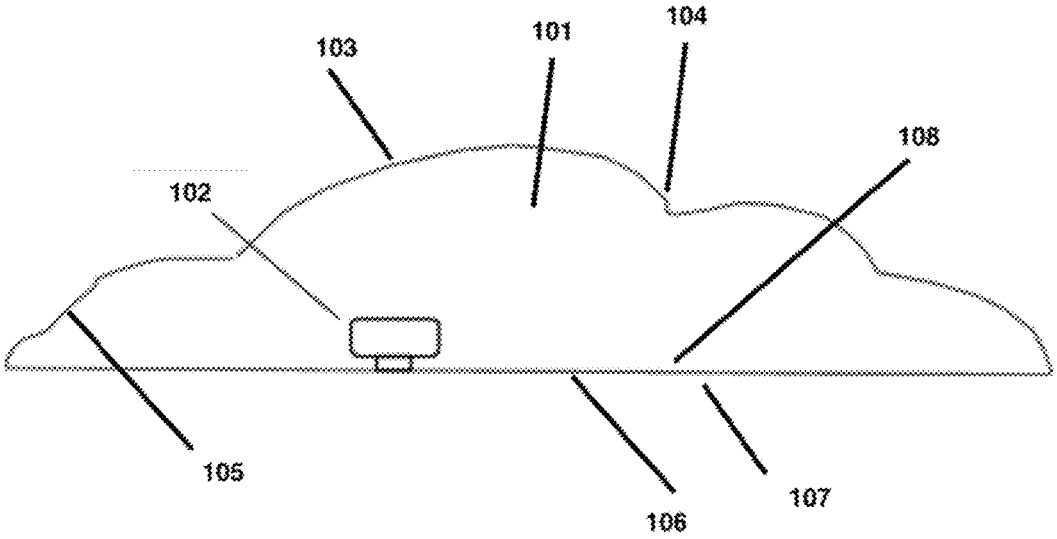
FIG. 2 is a section view of the cloud speaker lamp.

A section view of the lamp 100 is illustrated in FIG. 2, with the light source not shown. Referring to FIG. 2, sound is impressed on the enclosure shell 101 by means of a transducer 102 coupled to the enclosure back shell 106. The Cloud speaker enclosure shell 101 consists of the enclosure front shell 103, and the enclosure back shell 106. The enclosure front shell has an external surface 104, and an internal surface 105. The enclosure back shell has an external surface 107 for mounting and an internal surface 108 for mounting internal components. The transducer 102 imparts audio vibrations to the enclosure back shell 106 creating corresponding vibrations in the entire enclosure. The transducer 102 mounts to the enclosure back shell internal surface 108. The thin stiff material of the enclosure then couples the sound efficiently into the air.

Referring to FIGS. 3A, 3B, and 3C, the basic concept of a resonant enclosure is illustrated. In FIG. 3A, sound travels through air in the form of waves which can be described as having a wavelength or equivalently a frequency or pitch. When sound is introduced in a closed space, in the case of the lamp 100, within the enclosure, the air vibration displacement must be zero at the edges of the enclosure. FIG. 3B illustrates the approximate first mode of a flat plate. The lowest frequency vibration which will fit within the enclosure and vibrate in the interior of the enclosure and not at the edges, is the frequency at which the enclosure dimension corresponds to one half wave of the frequency, illustrated in FIG. 3B. FIG. 3C illustrates a plot of the displacement versus the locations relative to this first mode. This one frequency in particular is the lowest frequency at which the internal space of the enclosure can easily vibrate. The enclosure is very efficient at sound production at this frequency and will show a resonant peak in response. This is the pitch which is heard when one taps on the enclosure 101 and the enclosure 101 makes a boom sound. If the enclosure shell 101 is used as a loudspeaker enclosure, the enclosure shell 101 will tend to increase the audio intensity of this pitch.

When the frequency is doubled, as shown in FIGS. 4A and 4B, now a full cycle of the waveform fits the dimension of the enclosure shell 101 and another resonant condition exists, now at the doubled frequency. Other vibration patterns are possible, each producing resonant peaks at specific frequencies.

The lowest frequency resonances can dominate the audio response of the system and can make a loudspeaker enclosure sound boomy or mushy which is an undesirable attribute. These resonances have an effect of accenting lower frequencies. These frequencies are often increased to such a point that the effect is heard as boominess which can interfere with different musical pitches, so these effects need to be carefully controlled.

Figure 5A:
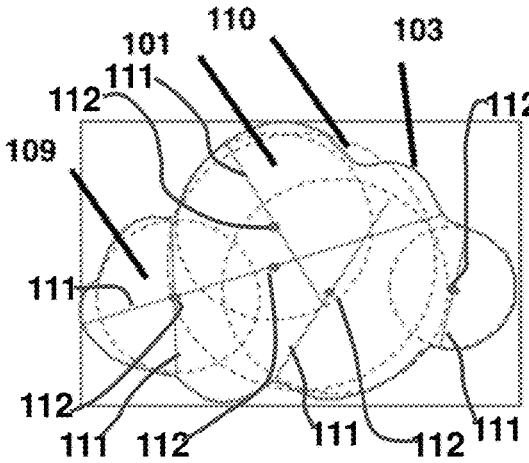
FIG. 5A is an illustration of analysis of the lowest enclosure cavity resonances.

As shown in FIG. 5A, the design of the enclosure shell 101 provides a control mechanism for the low resonances and their dominant effect on sound production. The basic shape of the enclosure front shell 103 provides the opportunity to form internal cavities 109 of varying size to spread out the frequencies created by this effect. This avoids frequencies which overlap and further reinforce the resonance effect.

Transducer placement is critical to minimize the resonance effect. For example, if the transducer 102 was attached at a position near the center of the enclosure 103, this would couple maximum energy into the system at the lowest resonant frequencies and overall balance of the sound would be dominated by these frequencies.

Figure 5B:
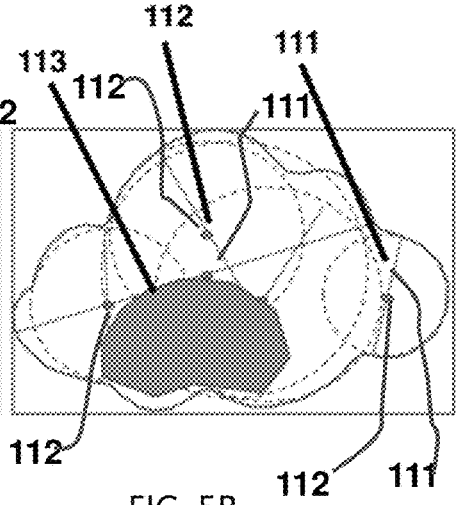
FIG. 5B is an illustration of the Mode 0 area of the enclosure of FIG. 5A.

Referring to FIG. 5A, an algorithm is presented for determining the position of the transducer to avoid the center of any of the lowest expected vibration patterns of the enclosure surface. The major resonance locations are superimposed as circular resonance areas 110 onto the cloud enclosure front shell 103 on an outline drawing, each circular resonance area 110 is bisected by a straight line 111, and the peak locations for resonances at the center 112 each line 111 are marked, which determines a pattern of dots. The largest area free of dots is outlined as the approved Mode 0 area 113, shown in FIG. 5B.

Figure 6A:
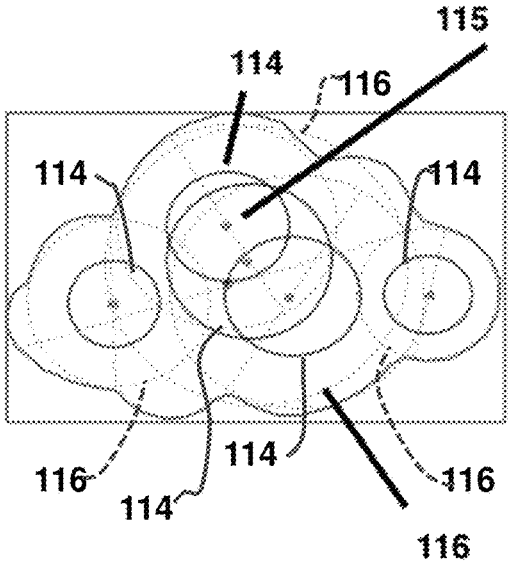
FIG. 6A is an illustration of analysis of the enclosure double frequency cavity resonances.
Figure 6B:
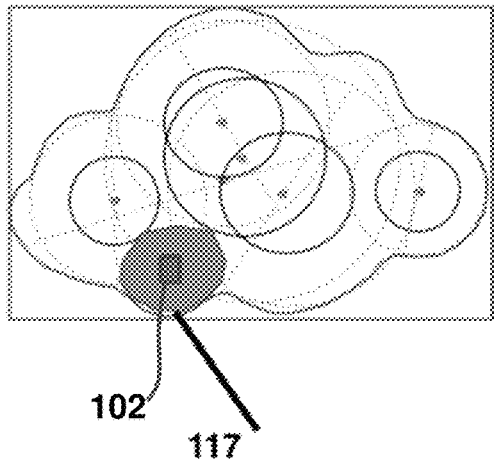
FIG. 6B is an illustration of the Mode 1 area of the enclosure of FIG. 6A.

FIG. 6A illustrates the technique for the double frequency resonances. Circles 114 are drawn at the half radius location 115 within each of the resonance circles 116, since this represents the locus of points for the maxima of the double frequency resonances. As shown in FIG. 6B, within the Mode 0 area, the largest area free of circles 117 is approved as the Mode 1 area. This addresses the two lowest and most troublesome classes of cavity resonance. The transducer 102 can be placed in the Mode 1 area.

In an exemplary embodiment, the transducer 102 can be a 25 watt, 8 ohm flat plate transducer measuring 58 mm by 58 mm as connected to the back shell internal surface 108.

In an exemplary embodiment, the transducer 102 is attached to the back shell internal surface 108 using a mounting system comprising four machined screws and washers (not shown) to spread the force of tightening these screws. Threadlocker compound can be used to lock these mounting screws in position.

Enclosure Geometry

In addition to cavity resonances, the enclosure shell 101 generates surface resonances. The enclosure shell 101 is the radiating element of the lamp 100 and in an ideal world would transmit the vibrations of the transducer 102 uniformly to all parts of its surface. In reality, the enclosure shell 101 possesses a large number of deformation and vibration modes of its own, and these form a critical part of the design.

Figure 7A:
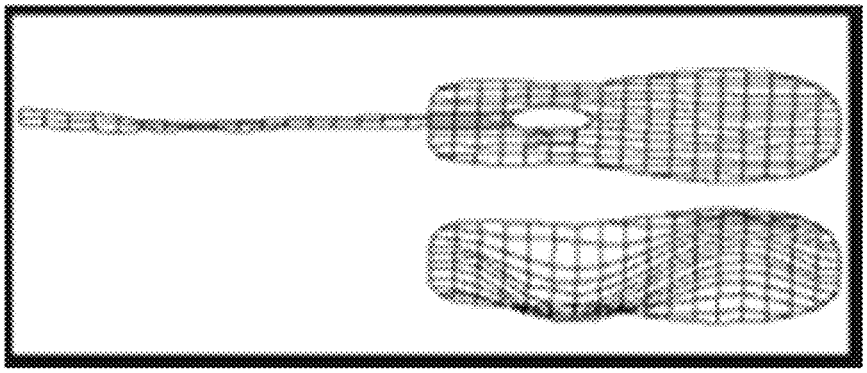
FIG. 7A is an illustration guitar and violin modes.
Figure 7B:
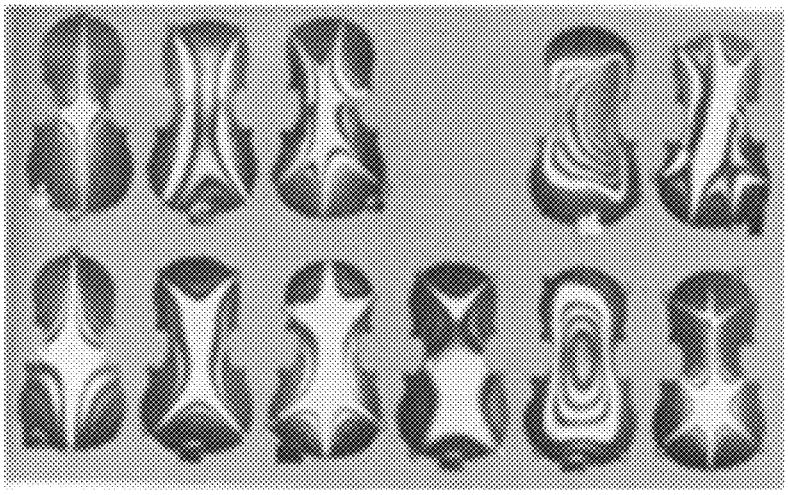
FIG. 7B is the approximate frequency response plot for a violin.

FIGS. 7A and 7B illustrate surface resonance effects with respect to select stringed instruments. FIG. 7A illustrates a guitar mode and FIG. 7B illustrates the various modes of a violin. The surface resonance effects result from the very complex system created by any physical instrument. Every part of a physical instrument has its own tendencies to resonate and contribute to the overall sound of the instrument.

Figure 8:
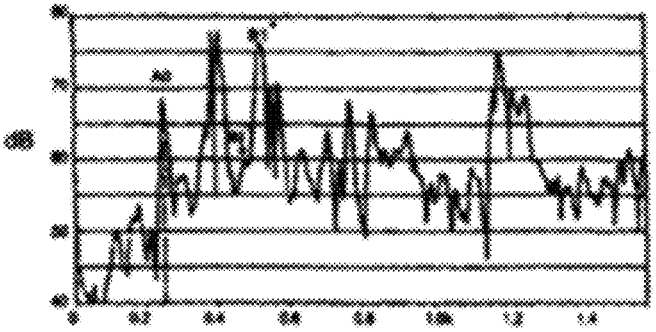
FIG. 8 is a graph illustrating a composite frequency characteristic for a violin.

The effects of all the various parts and cavities of the instrument construction combine to create a composite frequency characteristic as shown in the response chart for a violin in FIG. 8. Makers of such instruments know that their success lies in utilizing and adjusting these resonances to give the instrument character and tone. These effects may be clearly seen in a frequency response plot and they may be adjusted using additional bracing inside the chamber, increasing or decreasing the thickness of the shell, or changing the boundaries of the lobes or cavities of the enclosure for cloud speaker lamp design. The significant feature of FIG. 8 is the jaggedness of the plot. These jagged peaks are the minor resonances mostly associated with sections of the surface of the violin, which gives a properly constructed violin its acclaimed sound. If this were a straight horizontal line, i.e. flat response, the sound would be machine-like and boring. Research is very active in the violin community to understand what these peaks and dips each contribute relative to producing the perfect sound.

Figure 9:
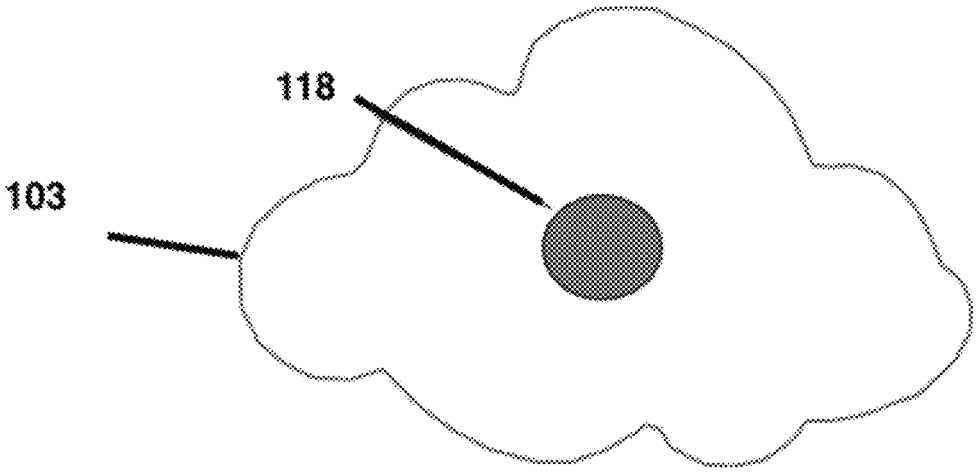
FIG. 9 is an illustration of sound port placement.

Regarding the cavity resonances, since the most troublesome mode is the lowest frequency, which has a sound pressure maximum at the center of the enclosure 103, FIG. 9 illustrates the introduction of a sound port 118 at the center of the back shell 106 of the enclosure 103 an effective reducer of the resonance effect. The sound port 118 provides a relief path for the air pressure vibrations, and the result can actually be felt as air flow in and out of the port 118, serving to remove energy from this vibratory mode.

Mounting

Figure 10:
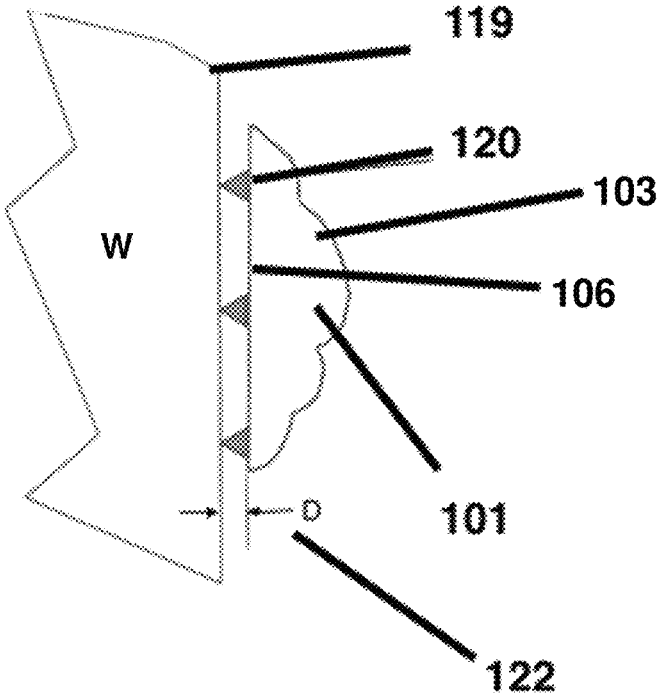
FIG. 10 is a section view showing standoffs.

A section view of the lamp 100 mounted on a surface is shown in FIG. 10. The mounting surface 119 behind the enclosure 103 plays an important part in the resulting sound. The mounting surface may be a wall. The lamp 100 is mounted on standoffs 120 that create a path for both the sound port sound and the sound produced by the enclosure back shell 106 of the lamp 100. Spacing 122 off the mounting surface 119 has a major effect on the system performance since it sets the time difference between the sound directly radiated off the enclosure front shell 103 and the reflected sound and low frequency sound from the flat enclosure back shell 106. The effect is very visible using a white noise source and a 3rd-octave analyzer. This spacing 122 is set after other sound treatment measures are completed, by moving the system through a range of spacing from 0 to 4 inches while watching the analyzer, and selecting the spacing which minimizes peaks near the center of the audio range from 100 Hz to 1000 Hz.

Mounting of the lamp 100 at a defined distance from the surface of a wall W, on cone-shaped standoffs 120. The distance is determined by the acoustical effects of the spacing, and also produces an appearance that the cloud is floating in the air and not attached to the wall.

Figure 11:
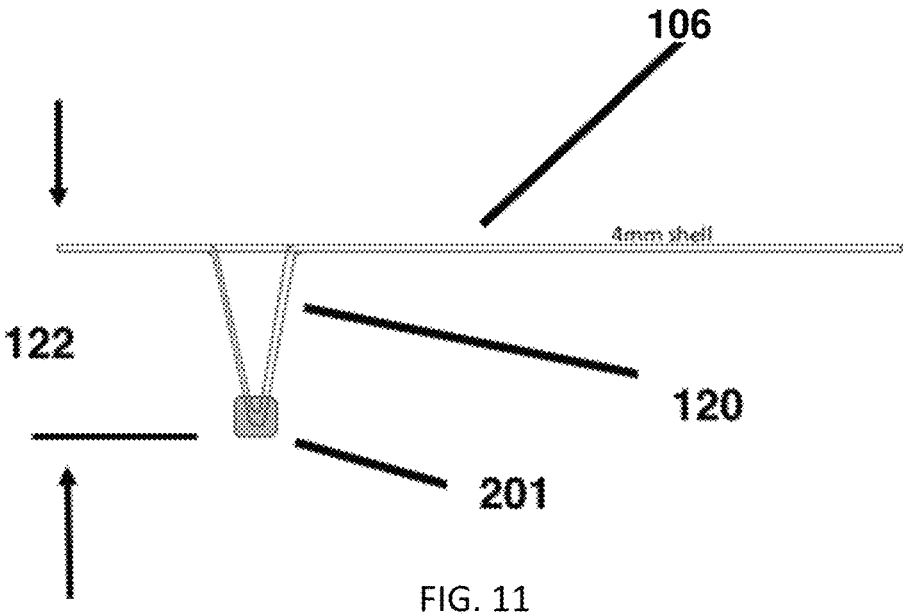
FIG. 11 is the standoff illustration.

FIG. 11 illustrates another variant of the wall mounting and spacing. In this variation, the cone shaped standoffs 120, with the larger end connected to the enclosure back shell 106, are used for wall mounting with a foam tip 201 to minimize rattling against the mounting surface. The cones may be molded into the enclosure back shell 106 for manufacturing efficiency.

Figure 12:
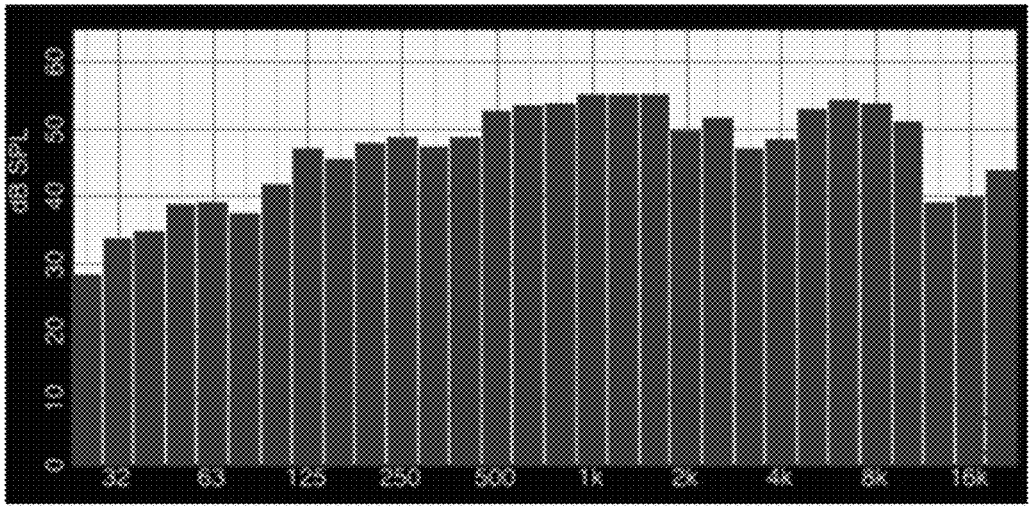
FIG. 12 is a sound pressure level versus frequency with cloud speaker lamp mounted 0.75 inches away from the wall.

The results of a white noise test conducted where the cloud speaker lamp was mounted 0.75 inches from the wall are shown in FIG. 12. The results are the sound pressure level versus frequency. This plot has a rounded contour and highest amplitudes in the 500 Hz to 2 KHz range.

Figure 13:
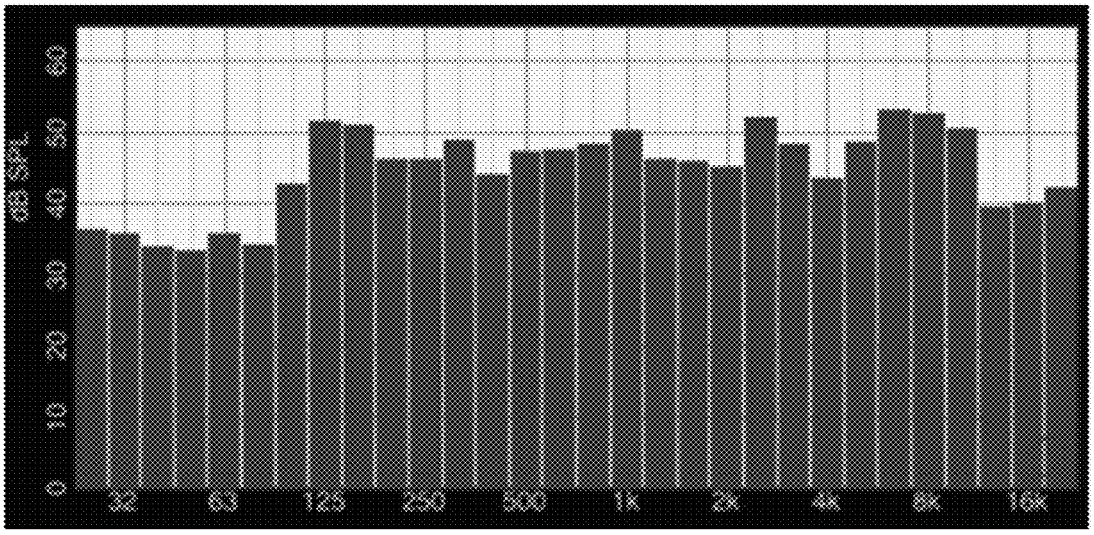
FIG. 13 is a sound pressure level versus frequency with cloud speaker lamp mounted 3 inches away from the wall.

The results of the white noise test conducted where the cloud speaker was mounted 3 inches from the wall W are shown in FIG. 13. This was the final result of test conducted at different distances from the wall W. As the cloud speaker lamp was moved slowly away from the wall, the response objective in the 100-250 Hz range increases and the 500 Hz to 2 KHz range decreases so that the entire region of 100 Hz to 10 KHz is balanced within approximately a 10 dB range and the quality of the sound improves dramatically. Based on the test results moving the cloud further than 3 inches from the wall W has a diminishing effect relative to improving the sound. The 3 inch spacing from the wall W to the enclosure back shell 106 was determined to be the optimum location since any larger spacing begins to be a mounting challenge for the enclosure as a consumer product.

In an exemplary embodiment, the standoffs 120 provide the 3 inch spacing out from the wall W or other mounting surface and the top standoff 120 clips onto a screw embedded in the wall W. Another embodiment of the standoffs 120 can feature nylon material with spring hold downs at both ends.

Light Source

Figure 14:
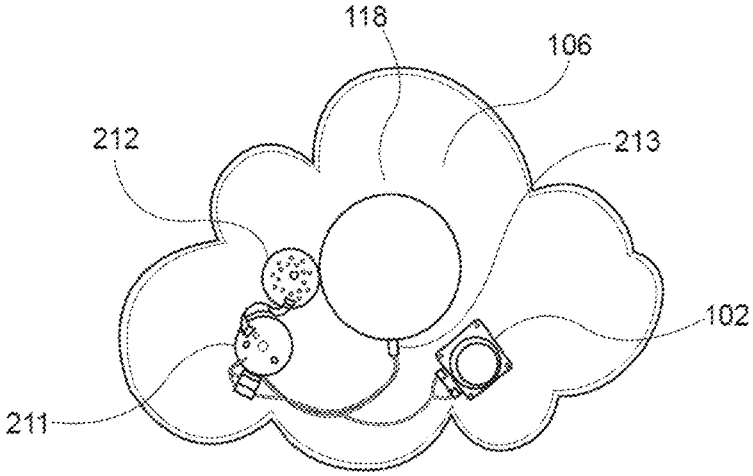
FIG. 14 is the internal components mounting.

Referring to FIG. 14, the light source 212 can be mounted on the back shell internal surface 106. The light source 212 can be a RGBW LED array with frequency comb that maps the audio input to the light spectrum, color and pulsation based on the intensity and frequency of the sound. Using this light source 212, the lamp 100 functions as a simple lamp for purpose of room lighting when switched on from a light switch where the input interface has been set to display white light.

Light source 212 and audio circuitry mounted on the same board as the light source 212), is a single small assembly that mounts at the center of the back shell internal face 105. Location consideration is the need to place the light source 212 in the center of the overall enclosure 103 and as far away from the front of the enclosure 103 as possible. The mass of the light source 212 is minimal and the light source 212 is powered by 12 Volt DC from a wall adapter (not shown) so the additional mass of a power supply is not needed inside the enclosure 103. The mounting of the light source 212 has a minimal effect on quality of the radiated sound, although mounting must be done in a way that will prevent rattles and buzzes.

The light source 212 has two speaker output wires that connect to the transducer 102 using standard faston connectors (not shown), which must be treated to prevent rattle since the transducer 102 itself will experience vibration. One way to accomplish this is by applying heat-shrinkable tubing over the connection after attachment.

Input Interface

In one of the embodiments, the input interface can be a Bluetooth unit, which combines a receiver for control signals, an audio receiver, an audio amplifier capable of driving the transducer, and an audio filter system which picks out bands of sound and uses the intensity levels to control light source LED lighting in Red, Green, Blue, and white. The input interfaces can be a 10 Watt amplifier with a Bluetooth antenna interface.

In still another embodiment, the lamp 100 can be used as a loudspeaker component where there is a wire connection from the music source which is routed to the audio amplifier and the audio filter system.

Internal Components

The arrangement of the internal components is illustrated in FIG. 14. The enclosure back shell 106 with the sound port 118 is illustrated to highlight the mounting of the internal components. The transducer 102 is mounted at location determined as disclosed above. The input interface 211 is an electronics board that includes Bluetooth transmission, audio input reception and amplification, and the LED illumination driver. The circular object local to the sound port 118 is the LED array 212. It should be noted that the sound port 118 illustrated is larger than the production version, which is 3.875 inches in diameter. All circuitry is powered by 12 VDC, which is connected via a DC power source connection 213. Both the input interface 211 and the LED array 212 attach to the enclosure back shell 106 using industrial adhesive.

Electronic boards are very low mass and do not affect the sound production of the system, although they must be mounted carefully to avoid rattles and buzzes.

Figure 15A:
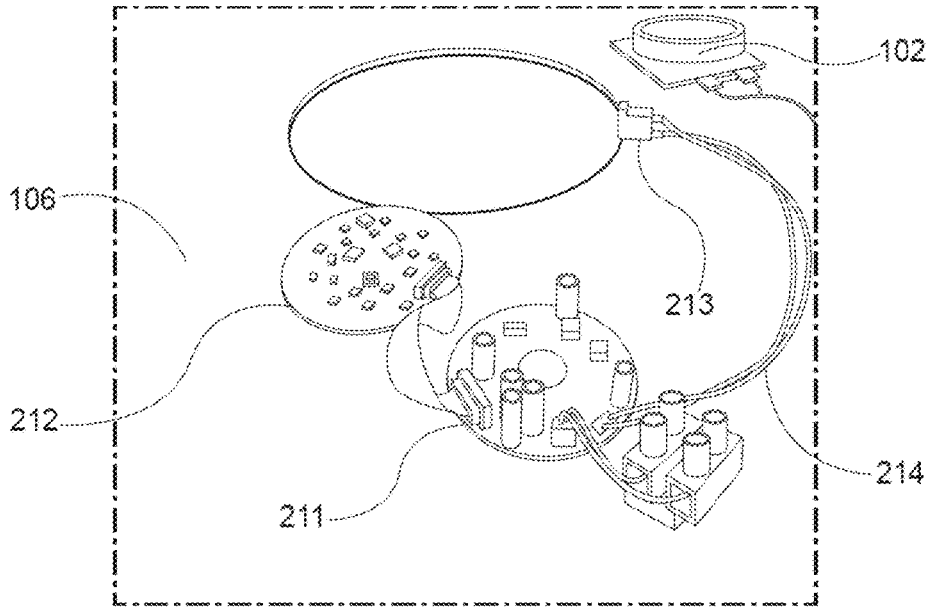
FIG. 15A is a close up internal components mounting, power cord, led array and input interface.
Figure 15B:
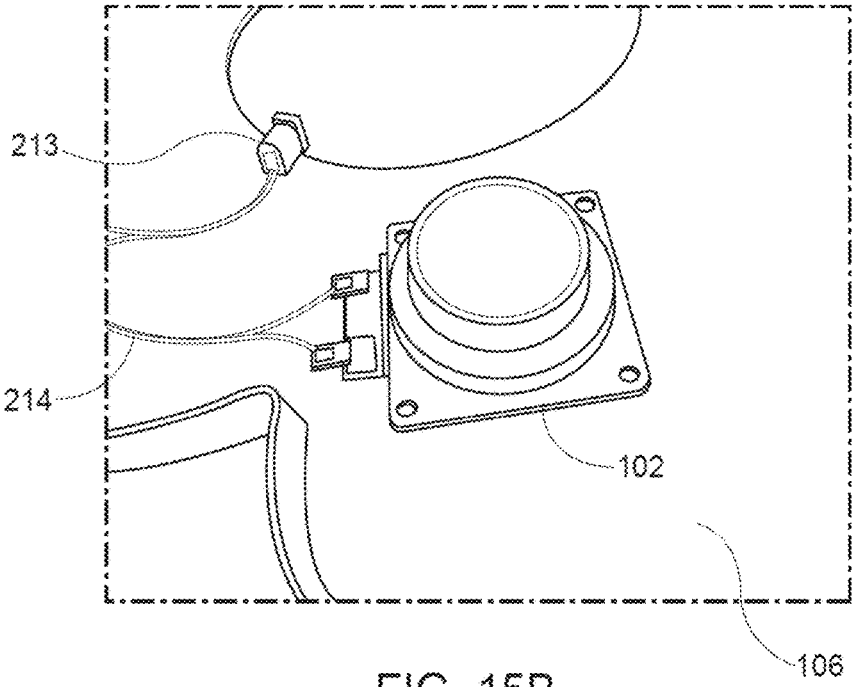
FIG. 15B is a close up internal components mounting, transducer and power cord.

A close up of the Input Interface 211, LED Array 212, and power source connection 213 mounting is illustrated in FIG. 15A. A close up of the mounting of the transducer 102 is illustrated in FIG. 15B. In FIGS. 15A and 15B, all connecting wires 214 are staked down to the enclosure back shell 106 using a 0.125 inch bead of silicone adhesive at 1 inch intervals. This staking prevents the wires 214 from making noise by vibrating against the enclosure back shell 106, and prolongs the life of the connecting wires 214 by preventing stress from being focused at the points where the wire insulation ends.

Power Source

The power source can be a 110 to 240 volt, 50/60 Hz alternating current to 12 Volt Direct Current 2 Ampere wall plug transformer with a 2.4 mm barrel plug. The power source connection can also be a conventional wire or a flat tape conductor which can provide unobtrusive wall mounting. The power source may also be direct current, battery powered.

In both FIGS. 15*a* and 15*b*, the system is powered by a 12V wall-mounted adapter (120 VAC-to-12 VDC), not shown. This attaches via a 6' 2-conductor cable, or alternatively a 6' 2-conductor flat ribbon wire which is fitted with a plug to mate with the power source connection 213. The effective wire size may be as small as 28 AWG. Ribbon construction can be chosen for ease of concealment, such as with adhesive tape. This construction eliminates any UL or CE issues with the lamp 100 itself, as long as the power adapter is compliant. Chargers may be "universal" accepting an input power range such as 70 VAC-280 VAC, or may be tailored to the locality, 240 VAC input, 208 VAC input, etc. The use of 12 VDC as the required system voltage results in global usability.

Stereo Embodiment

Figure 16:
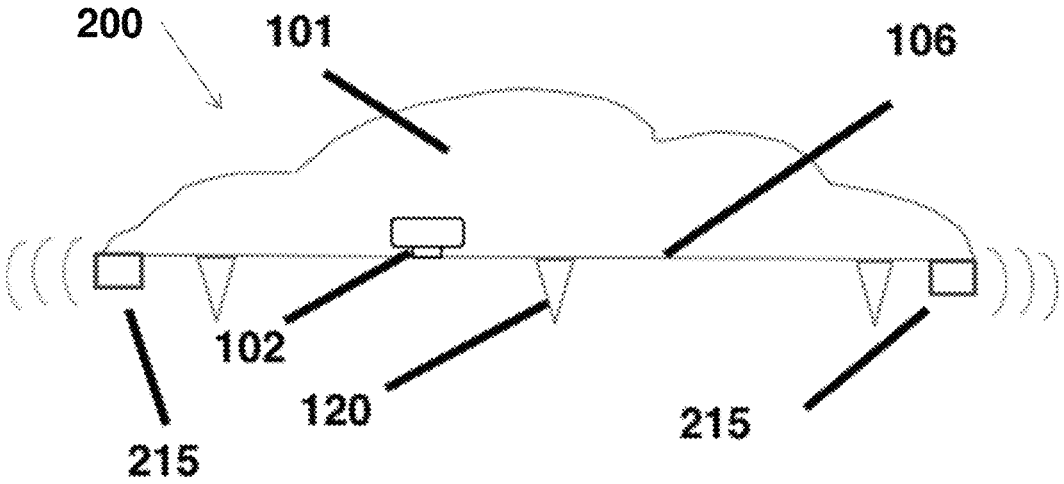
FIG. 16 is an alternative embodiment, for stereo sound production.

In a second embodiment of a cloud speaker lamp 200, illustrated in FIG. 16, stereo is added by providing a two channel version of the input interface, an audio and command receiver (contained on the input interface 211, shown in FIG. 14) and two or three channels of amplified audio signals from the audio amplifier. Since the primary sense of directionality in sound occurs at the higher frequencies above a crossover frequency, fc, the transducer 102 and enclosure 101 may be used for medium and low frequency amplified audio signal, and two high-frequency drivers 215 can be mounted at the enclosure back shell 106 sides of the back shell 106 for amplified audio signals above the crossover frequency. The high frequency drivers 215 are conventional air-coupled loudspeakers, which offer the required directionality. The high frequency drivers 215 are high frequency speakers. The cross over frequency parameter fc is 2,000 Hz, chosen based on effective range of the high frequency drivers 215 used and can be adjusted as new high frequency drivers become available. The audio amplifier in the input interface can be modified to filter the program material into three channels: the left channel, 2,000 Hz and above, sent to the left high frequency speaker; the right channel 2,000 Hz and above, sent to the right high frequency speaker, and center channel, 2,000 Hz and below, sent to the enclosure transducer 102. The center channel may be left unfiltered and the full range signal may be fed to the transducer 102 if economies dictate, however this will diminish the separation provided by the system. While 2,000 Hz is selected as an exemplary frequency, those skilled in the art will recognize that other frequencies can be selected as the crossover frequency.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A device for producing light and sound comprising:

(a) an enclosure for sound and light radiating, the enclosure having a front shell, a back shell attached to the front shell, and a plurality of cone shaped standoffs extending from the back shell, away from the front shell;

wherein the enclosure is used for sound generation and as a translucent light projector, (b) an input interface configured to receive an audio input signal and a command input signal, the input interface including:

an audio and command receiver adapted to receive the audio input signal and the command input signal from an external source;

an audio processor having an audio filter and an audio amplifier, the audio amplifier being adapted to receive the audio input signal from the audio and command receiver and generate an amplified audio signal, the audio filter being adapted to receive the audio input from the audio and command receiver and generate a processed audio signal which selects sound frequency associated with light intensity; and an illumination driver adapted to receive the command signal from the audio and command receiver and the processed audio signal from the audio filter in the audio amplifier, wherein the processed command signal controls color selection and the processed audio signals control light intensity;

(c) a transducer configured to receive the amplified audio signal from the audio amplifier in the audio processor, in the input interface and acoustically excite the enclosure, the transducer connected to the back shell, wherein the location of the transducer connection to the back shell internal side is selected to optimize the acoustic response of the enclosure;

(d) a light source adapted to receive the command signal and the processed audio signal from the illumination driver in the input interface, the command signal commanding color selections, and the processed audio signal results in pattern generation and light intensity variations, the light source being mounted on the back shell for illumination of the enclosure front shell.

2. The device according to claim 1, wherein the power source is an Alternating Current based power source.

3. The device according to claim 1 wherein the power source is Direct Current based power source.

4. The device according to claim 1 wherein the input interface audio input is accomplished via a direct wire connection.

5. The device according to claim 1, wherein the input interface is accomplished via a Bluetooth antenna interface.

6. The device according to claim 1, wherein the enclosure material is acrylic.

7. The device according to claim 1, wherein the audio amplifier generates a single channel amplified audio signal to drive the transducer.

8. The device according to claim 1, wherein the audio amplifier generates a multiple channel amplified audio signal to drive the transducer, and at least one high frequency driver, wherein an appropriate crossover frequency is selected so that the at least one high frequency driver outputs sound above the crossover frequency and the transducer outputs sound below the crossover frequency.

9. The device according to claim 8, wherein the crossover frequency is about 2,000 Hz.

10. The device according to claim 1, wherein the audio processor is mounted on the back shell.

11. The device according to claim 1, wherein the front shell is cloud shaped.

12. The device according to claim 1, wherein the back shell is flat.

13. The device according to claim 1, wherein the back shell comprises a circular sound port opening through the back shell to facilitate the movement of air.

14. The device according to claim 13, wherein the back shell has a back shell internal surface and a back shell external surface, and wherein the back shell external surface is mountable on a mounting surface via the plurality of cone shaped standoffs.

15. A device for producing light and sound comprising:

(a) an enclosure for sound and light radiating, the enclosure having a front shell and a back shell attached to the front shell;

(b) a transducer fixed to the back shell, the transducer configured to acoustically excite the enclosure; and (c) a light source electronically connected to the transducer and adapted to generate light pattern and light intensity variations based on output from the transducer, wherein the front shell comprises a plurality of internal cavities having different sizes and wherein sizes and locations of the plurality of internal cavities generate an area free of resonance circle, wherein the transducer is fixed on the back shell within the area.

16. The device according to claim 15, wherein the area is determined as a largest area within the enclosure being free from half radius circles of each of the plurality of internal cavities.

17. The device according to claim 15, wherein the transducer generates sound at a frequency at and below a cross over frequency.

18. The device according to claim 17, further comprising a plurality of high frequency speakers attached to the back shell and configured to generate sound at a frequency above the cross over frequency.

* * * * *